US006010130A

United States Patent [19]

Schreiber

[11] Patent Number: 6,010,130

[45] **Date of Patent: *Jan. 4, 2000**

[54] VERTICAL MARBLE GAME

[75] Inventor: J. David Schreiber, Bay, The Hong Kong Special Administrative Region of the People's Republic of China

[73] Assignee: Uncle Skunkle Toys, Inc., Lake Oswego, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 09/019,413

[22] Filed: Feb. 5, 1998

[51] Int. Cl.[7] ..... A63F 7/02

[52] U.S. Cl. ..... 273/121 B; 273/118 R

[58] Field of Search ..... 273/118 R, 119 R, 273/120 R, 121 R, 121 B, 123 R, 126 R

[56] References Cited

U.S. PATENT DOCUMENTS

| | | | |
|---|---|---|---|
| 2,571,521 | 10/1951 | Barnhart | 273/120 R |
| 3,278,187 | 10/1966 | Sinden | 273/118 R |
| 3,388,483 | 6/1968 | Weisbecker | 273/118 R |
| 3,592,471 | 7/1971 | Swimmer et al. | 273/120 R |
| 3,638,945 | 2/1972 | Breslow | 273/120 R X |
| 3,758,113 | 9/1973 | Trbovich et al. | 273/120 R |
| 3,851,879 | 12/1974 | Hicks | 273/120 R |
| 3,934,881 | 1/1976 | Goldfarb et al. | 273/120 R X |
| 4,055,344 | 10/1977 | Soucie | 273/123 R X |
| 4,474,558 | 10/1984 | Quercetti . | |

FOREIGN PATENT DOCUMENTS

| | | |
|---|---|---|
| 1466847 | 3/1977 | United Kingdom . |

*Primary Examiner*—Raleigh W. Chiu
*Attorney, Agent, or Firm*—Robert D. Varitz, PC

[57] ABSTRACT

A vertical marble game includes marbles; an upright marble track having plural elongate, vertical slots therein, at least one diverter associated with each vertical slot, wherein each diverter is shiftable about an axis, and wherein a marble, released at the upper end of a vertical slot is operable to shift one or more of the diverters, thereby diverting the marble from the first mentioned vertical slot to an adjacent vertical slot; and a catchment tray located at the lower end of the marble track having plural, horizontal slots, equal in number to those of the vertical track, wherein each horizontal slot is sized to receive a predetermined number of marbles therein.

6 Claims, 2 Drawing Sheets

VERTICAL MARBLE GAME

FIELD OF THE INVENTION

This invention relates to amusement devices, and specifically to a marble game which includes randomly operable diverters within a game track.

BACKGROUND OF THE INVENTION

Marble games, including pinball games, incorporate a variety of tracks for the marbles to follow, and may include passive or active diverters, or flippers, which the marble or player, respectively, may operate to change the course of a marble through a track.

SUMMARY OF THE INVENTION

A vertical marble game includes marbles; an upright marble track having plural elongate, vertical slots therein, at least one diverter associated with each vertical slot, wherein each diverter is shiftable about an axis, and wherein a marble, released at the upper end of a vertical slot is operable to shift one or more of the diverters, thereby diverting the marble from the first mentioned vertical slot to an adjacent vertical slot; and a catchment tray located at the lower end of the marble track having plural, horizontal slots, equal in number to those of the vertical track, wherein each horizontal slot is sized to receive a predetermined number of marbles therein.

DETAILED DESCRIPTION OF THE PREFERRED EMBODIMENTS

Figure 2:
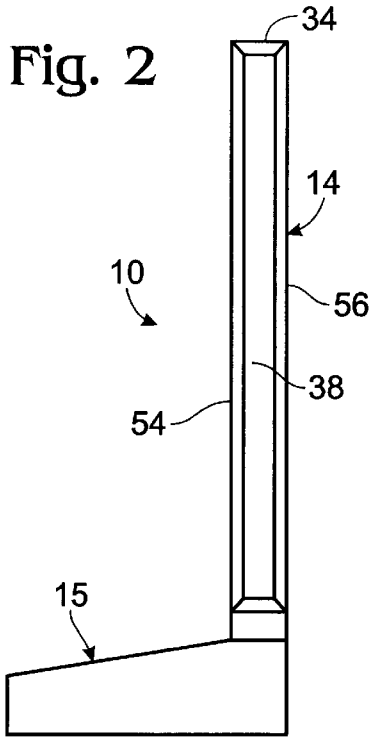
FIG. 2 is a side elevation of the marble track of FIG. 1.
Figure 1:
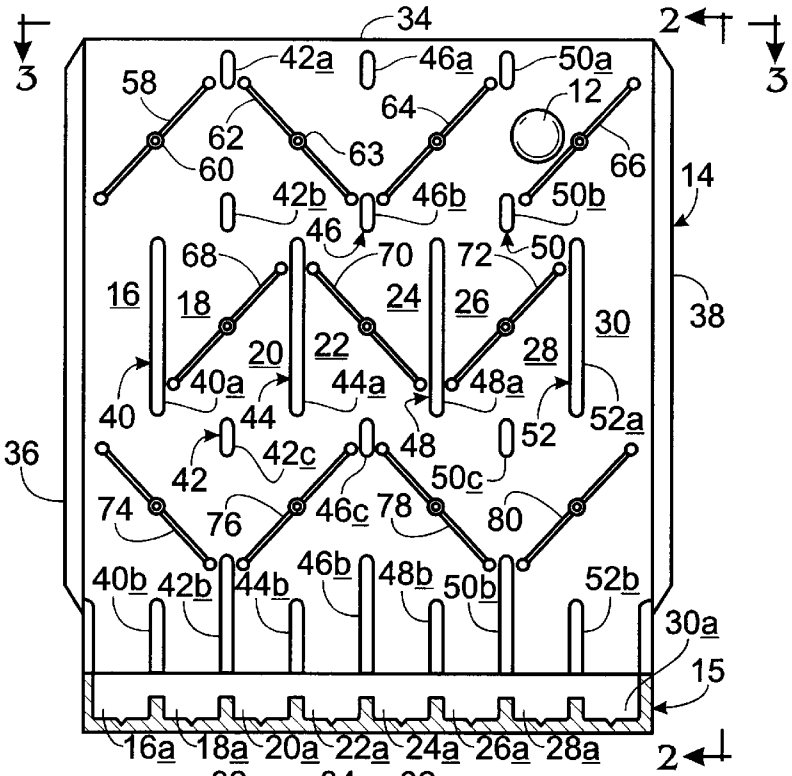
FIG. 1 is a front elevation of the marble track of the invention, with portions of the catchment tray thereof cut away to show detail.
Figure 3:
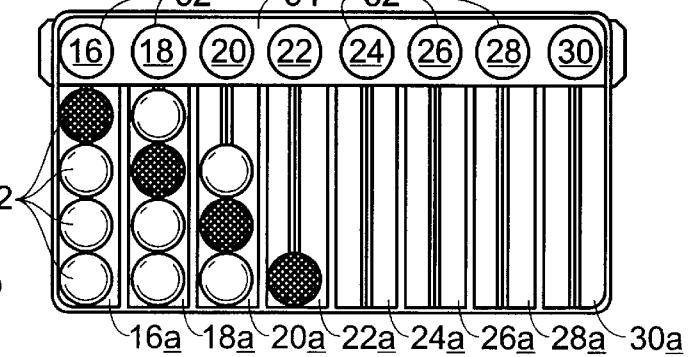
FIG. 3 is a top plan view of the marble track and catchment tray of the invention.

Turning now to FIGS. 1–3, a first embodiment of the apparatus of the vertical marble game of the invention is depicted generally at 10. Apparatus 10 includes plural marbles, depicted generally at 12. An upright marble track is depicted at 14 and is connected to a catchment tray 15. Track 14 includes plural, elongate vertical slots, depicted by even numbers 16–30. A marble gains entrance to each slot through an opening 32 in the top 34 of vertical track 14. Each vertical slot terminates in a corresponding horizontal slot, designated by even numbers 16*a*–30*a*, located in catchment tray 15.

As is depicted in FIG. 1, marble track 14 includes exterior sidewalls 36, 38. The track also includes interior sidewalls even numbered 40–52. Each interior sidewall includes a portion thereof which is shiftable about an axis, or pivot point, extended between the front wall 54 and rear wall 56 of marble track 14. Such a device, referred to herein as a diverter, a flipper, or flipper sidewall portion, is depicted at 58 and includes a pivot 60, which extends between front wall 54 and rear wall 56 of marble track 14. The flipper 58 is free to rotate about pivot point 60, within the limits defined by the length of the flipper and fixed wall portions, such as fixed portions 42*a* of interior wall 42 and sidewall 36. Likewise, a flipper 62 is rotatable about a pivot point 63, and is constrained by wall portion 42*a* and wall portion 46*a*. Other flippers are designated by even numbers 64–80. The flippers may be constructed so as to freely rotate upon being struck by a falling marble, or they may have a certain amount of resistance, which will still result in a flipper moving under the influence of a falling marble, but may also result in the marble being diverted into another vertical slot.

It may be seen that a marble dropped into the top of slot 22 will initially fall until it contacts flipper 62. This will cause flipper 62 to rotate to another position, other than that shown in FIG. 1, thereby allowing the marble to pass into slot 22, until it contacts flipper 70. The upper portion of flipper 70 will not move and the marble will be directed downward along flipper 70 until such time as the lower portion thereof is contacted which will shift the flipper to a different position, allowing the marble to fall through slot 46, where it will contact flipper 78, which will direct it into slot 26, and ultimately into horizontal slot 26*a*. The foregoing presumes that the flippers are completely free to rotate about their pivot points. However, as previously noted, the apparatus may be so constructed that the flippers have a certain frictional contact with the front and rear walls of the vertical marble track, which may cause a marble to bounce off of a flipper into another slot. For instance, returning to the first example, if the marble is initially dropped into slot 22 and bounces off of flipper 62, it may rebound off of flipper 64 back to flipper 62 or, may pass into slot 24 at an upper portion thereof. Eventually, the marble will reach the lower portion of track 14, and come to rest in catchment tray 15.

In the preferred embodiment, catchment tray 15 is sized so that four marbles may be received within each of the horizontal slots thereof. Each player uses different colored marbles, and the object of the game is to get four marbles in a row in catchment tray 15. The four marbles may be in a single horizontal slot, or, there may be four marbles in four adjacent horizontal slots, at the same level in each of the horizontal slots, or a diagonal run of four marbles may be positioned through four adjacent horizontal slots.

Each player takes a turn dropping a marble into an opening above a specific vertical slot. The game continues until a winning combination is formed. In the event that five marbles fall into one horizontal slot, the first marble is removed from the tray and is used to continue play.

Players may make both offensive and defensive moves. For instance, if it appears that one player is about to score a winning combination, the route to a specific horizontal slot may be blocked by strategic dropping of a marble by another player, thereby shifting the flippers so that the brevet winning player does not have an opportunity to put a marble into a winning combination in the horizontal slots.

Figure 5:
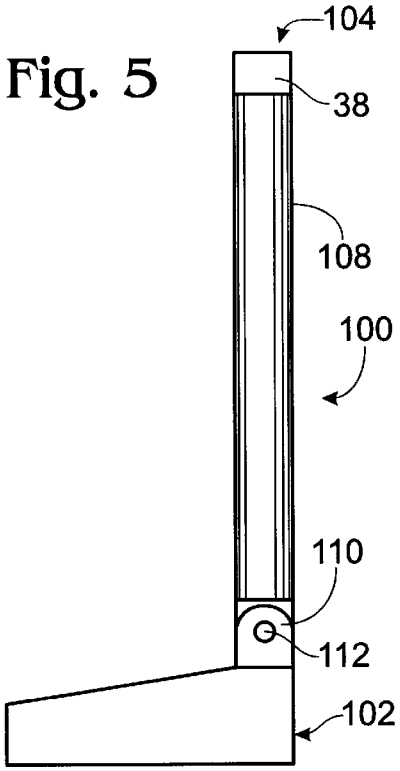
FIG. 5 is a side elevation of the marble track of FIG. 4.
Figure 4:
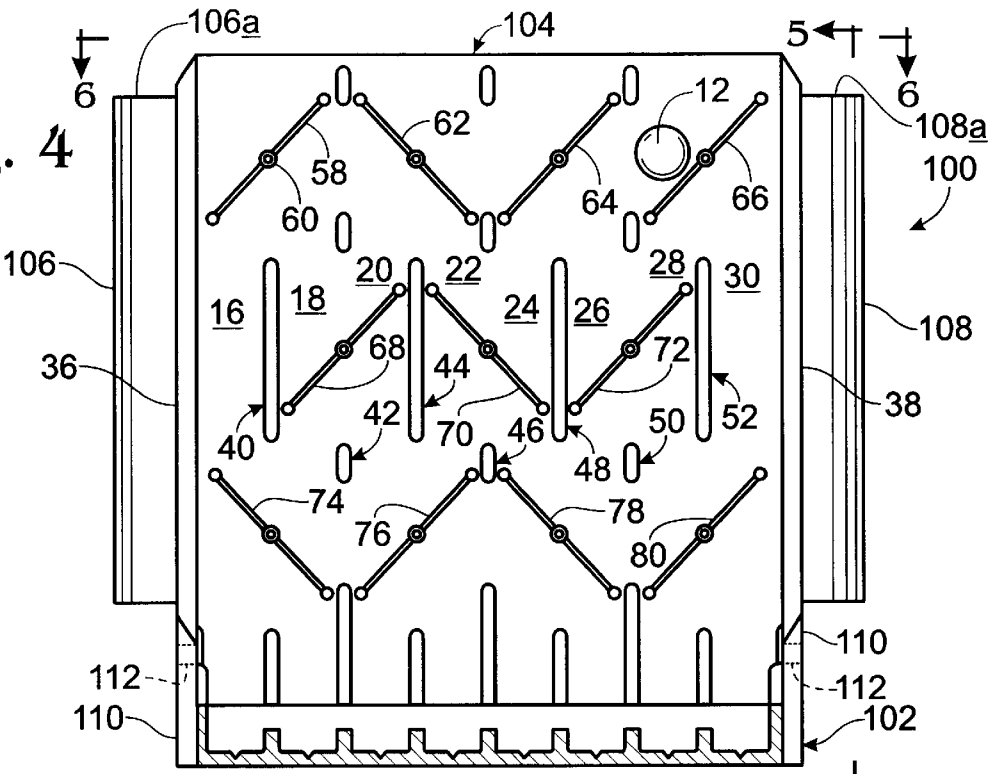
FIG. 4 is a front elevation of an alternate embodiment of the marble track of the invention, with portions of the catchment tray thereof cut away to show detail.
Figure 6:
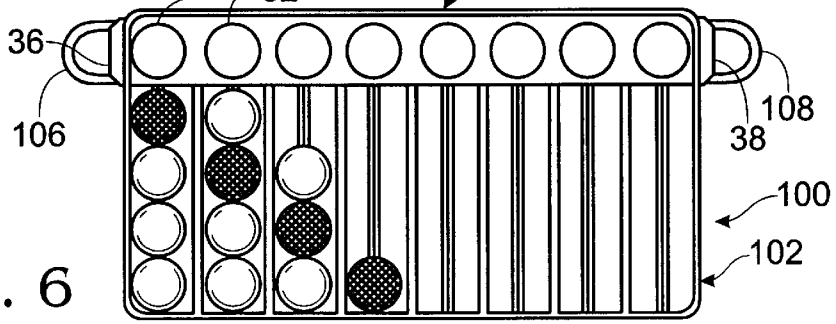
FIG. 6 is a top plan view of the marble track and catchment tray of the marble track of FIG. 4.

Turning now to FIGS. 4–6, an alternate embodiment of the apparatus of the invention is depicted generally at 100. Apparatus 100 includes a modified catchment tray 102 and a modified marble track 104. Marble track 104 may be seen to include a marble storage compartment 106, 108 on either side thereof, which allows the storage of marbles when the apparatus is not in use. Compartments 106, 108 have a closed bottom, and a removable top cover, 106*a*, 108*a*, respectively, to contain the marbles regardless of the orientation of the apparatus.

Marble track 104 is pivotable relative to catchment tray 102 by means of catchment tray flanges 100 and pins 100 located on marble track 104. This arrangement allows folding of the apparatus for storage and transport.

Thus, an apparatus and method of play for a vertical marble game has been disclosed.

I claim:

1. A vertical marble game comprising:

marbles;

an upright marble track having plural elongate, vertical slots therein, having a fixed wall portion located on either side thereof, at least one elongate diverter associated with each vertical slot, wherein said diverter is balanced on an axis and is shiftable about said axis, which is located at the center of gravity of said diverter, and wherein a marble, released at the upper end of a vertical slot is operable to shift one or more of said diverters, thereby diverting said marble from said first mentioned vertical slot to an adjacent vertical slot, wherein said diverter is free to rebound once shifted as to come to rest anywhere within the limits defined by the length of said diverter and said fixed wall portion; and a catchment tray located at the lower end of said track having plural, horizontal slots, equal in number to those of said vertical track, wherein each horizontal slot is sized to receive a predetermined number of marbles therein.

2. The apparatus of claim 1 wherein said marble track includes a marble storage compartment carried thereon.

3. The apparatus of claim 1 wherein said marble track is foldable relative to said catchment tray.

4. A vertical marble game comprising:

marbles;

an upright marble track having a front wall, a rear wall, and plural elongate, vertical slots therein, wherein said vertical slots are sized to freely receive a marble there through, wherein said vertical slots include interior sidewalls within said track on at least one side thereof, wherein at least a portion of each interior sidewall a fixed wall portion, and another portion of each interior sidewall is a shiftable portion balanced on an axis and is shiftable about said axis, wherein said axis is located at the center of gravity of said shiftable portion, extending between said front wall and said rear wall, wherein a marble, released at the upper end of a vertical slot is operable to shift one or more of said shiftable portions of an interior sidewall as it courses through the marble track, wherein said shiftable portion is free to rebound once shifted as to come to rest anywhere within the limits defined by the length of said shiftable portion and said fixed wall portion; and a catchment tray located at the lower end of said track having plural, horizontal slots, equal in number to those of said vertical track, wherein each horizontal slot is sized to receive a predetermined number of marbles therein.

5. The apparatus of claim 4 wherein said marble track includes a marble storage compartment carried thereon.

6. The apparatus of claim 4 wherein said marble track is foldable relative to said catchment tray.

* * * * *